US011573589B2

(12) United States Patent
Hung et al.

(10) Patent No.: US 11,573,589 B2
(45) Date of Patent: Feb. 7, 2023

(54) REFERENCE VOLTAGE CIRCUIT

(71) Applicant: NUVOTON TECHNOLOGY CORPORATION, Hsinchu (TW)

(72) Inventors: Yeh-Tai Hung, Hsinchu Science Park (TW); Tu-Yiin Chang, Hsinchu Science Park (TW)

(73) Assignee: NUVOTON TECHNOLOGY CORPORATION, Hsinchu (TW)

( * ) Notice: Subject to any disclaimer, the term of this patent is extended or adjusted under 35 U.S.C. 154(b) by 0 days.

(21) Appl. No.: 17/480,646

(22) Filed: Sep. 21, 2021

(65) Prior Publication Data

US 2022/0197324 A1 Jun. 23, 2022

(30) Foreign Application Priority Data

Dec. 22, 2020 (TW) ..... 109145494

(51) Int. Cl.
*G05F 3/24* (2006.01)
*G05F 1/565* (2006.01)
*G05F 1/46* (2006.01)

(52) U.S. Cl.
CPC ..... *G05F 3/24* (2013.01); *G05F 1/461* (2013.01); *G05F 1/565* (2013.01)

(58) Field of Classification Search
CPC ..... G05F 3/24; G05F 1/461; G05F 1/565
See application file for complete search history.

(56) References Cited

U.S. PATENT DOCUMENTS 7,932,772 B1 * 4/2011 Zarabadi ..... H02M 3/073 327/539
2011/0001568 A1 * 1/2011 Lin ..... H03K 19/00369 331/34

* cited by examiner

*Primary Examiner* — Kyle J Moody
*Assistant Examiner* — Lakaisha Jackson
(74) *Attorney, Agent, or Firm* — Snyder, Clark, Lesch & Chung, LLP

(57) ABSTRACT

A reference voltage circuit is disclosed. In the reference voltage circuit, a comparator compares a reference voltage and a voltage of a capacitor, so as to output a comparison signal; a controller checks conditions of the reference voltage and the leakage current based on the comparison signal; when a voltage of the capacitor is reduced too quickly, the controller adjusts a switching frequency of a switch device to effectively maintain the voltage of the capacitor.

10 Claims, 7 Drawing Sheets

REFERENCE VOLTAGE CIRCUIT

CROSS-REFERENCE TO RELATED APPLICATION

This application claims the benefit of Taiwan Patent Application No. 109145494, filed on Dec. 22, 2020, in the Taiwan Intellectual Property Office, the disclosure of which is incorporated herein in its entirety by reference.

BACKGROUND OF THE INVENTION

1. Field of the Invention

The present invention relates to a reference voltage circuit using a comparator, a switch device and a capacitor to check conditions of a reference voltage and a leakage current.

2. Description of the Related Art

In recent years, microprocessors are widely applied in various fields such as human-machine interface or industrial computers. The reference voltage is the key to the operation of a microprocessor, so how to design a reference voltage circuit that provides the accurate reference voltage is becoming more and more important.

The existing reference voltage circuit stores the reference voltage in a capacitor, and use a switching scheme to update and maintain the voltage of the capacitor. However, the capacitor may have varied leakage current and the conventional switching scheme operated to turn on/off at a predetermined frequency, and it causes the reduction in accuracy of the reference voltage.

Therefore, the inventors of the present invention develop a reference voltage circuit to solve the above-mentioned conventional technology problem.

SUMMARY OF THE INVENTION

An objective of the present invention is to provide a reference voltage circuit, so as to solve the above-mentioned conventional problems.

In order to achieve the objective, the present invention provides a reference voltage circuit comprising a bandgap reference circuit, a switch device, a capacitor, and a controller. The capacitor has a first terminal electrically connected to the bandgap reference circuit through the switch device. The controller is configured to output a switching signal to control the switch device, and the switching signal has a switching frequency. In a first operating mode, the controller controls the switch device to periodically turn on and off at the switching frequency, so as to control the bandgap reference circuit to charge the capacitor periodically at the switching frequency, and a voltage on the first terminal of the capacitor is used as an output voltage of the reference voltage circuit. In a second operating mode, the controller controls the switch device to control the switch device to turn off, so as to make the voltage on the first terminal of the capacitor reduce, and the controller determines the switching frequency based on a reduction speed of the voltage on the first terminal of the capacitor.

According to an embodiment of the present invention, the reference voltage circuit further comprises a comparator having a positive terminal and a negative terminal, the positive terminal is coupled to the bandgap reference circuit, the negative terminal is coupled to the first terminal of the capacitor, and the comparator is activated in the second operating mode, and the comparator is triggered to output a comparison signal to the controller in response to the reduction amount of voltage on the first terminal of the capacitor, the controller determines the reduction speed of the voltage on the first terminal of the capacitor according to the time of receiving the comparison signal.

According to an embodiment of the present invention, the controller comprises a counter configured to count to generate a counting value during a voltage reduction period of the negative terminal of the comparator, and the counter stops counting when receiving the comparison signal, and the controller determines the switching frequency based on the counting value.

According to an embodiment of the present invention, in the second operating mode, the controller increases the switching frequency when determining that the counting value is lower than the threshold.

According to an embodiment of the present invention, in the second operating mode, the controller decreases the switching frequency when determining that the counting value is higher than the threshold.

According to an embodiment of the present invention, in the first operating mode, when the controller controls the switch device to turn on, the bandgap reference circuit charges the capacitor to make the voltage on the first terminal of the capacitor reach the voltage outputted by the bandgap reference circuit.

According to an embodiment of the present invention, in the first operating mode the comparator is not activated.

According to an embodiment of the present invention, the controller periodically enters the second operating mode.

According to an embodiment of the present invention, the controller enters the second operating mode when receiving a trigger event.

According to an embodiment of the present invention, the controller converts the counting value into the switching frequency based on a preset ratio or a lookup table.

According to above-mentioned contents, the reference voltage circuit of the present invention can adaptively adjust the switching frequency of the switch device based on the length of the voltage reduction period of the capacitor, so as to effectively maintain the output voltage of the reference voltage circuit.

BRIEF DESCRIPTION OF THE DRAWINGS

The structure, operating principle and effects of the present invention will be described in detail by way of various embodiments which are illustrated in the accompanying drawings.

DETAILED DESCRIPTION OF THE PREFERRED EMBODIMENTS

Figure 1:
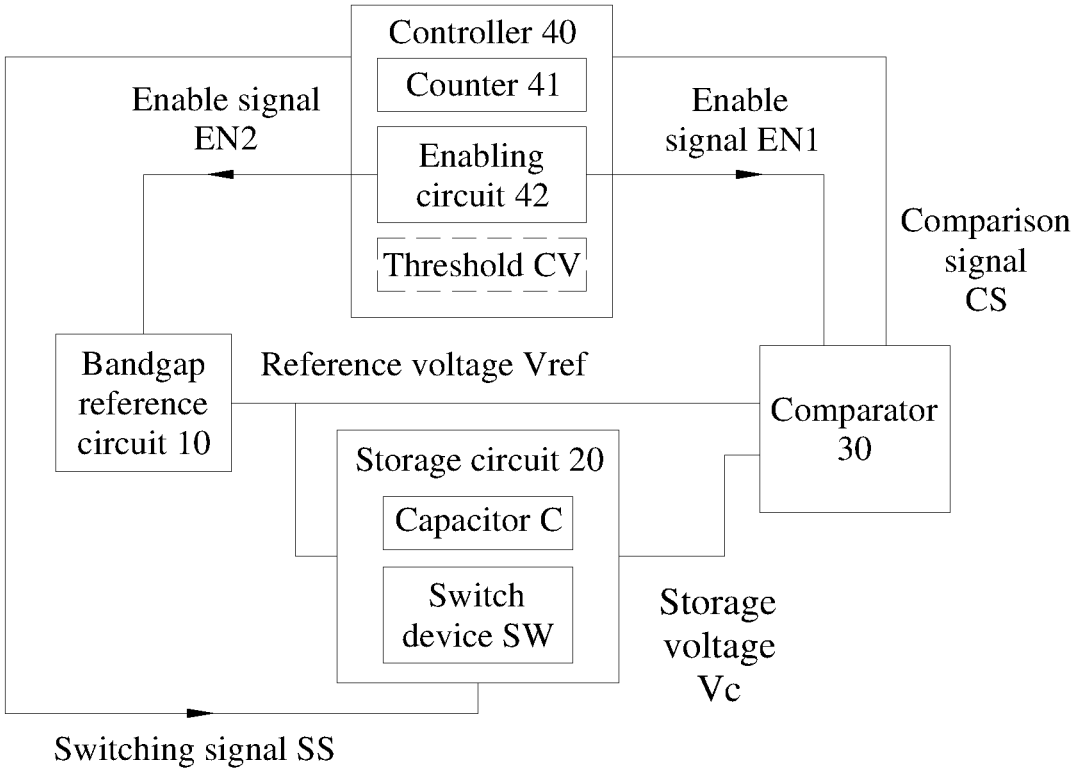
FIG. 1 is a block diagram of a reference voltage circuit, according to an embodiment of the present invention.

The following embodiments of the present invention are herein described in detail with reference to the accompanying drawings. These drawings show specific examples of the embodiments of the present invention. These embodiments are provided so that this disclosure will be thorough and complete, and will fully convey the scope of the invention to those skilled in the art. It is to be acknowledged that these embodiments are exemplary implementations and are not to be construed as limiting the scope of the present invention in any way. Further modifications to the disclosed embodiments, as well as other embodiments, are also included within the scope of the appended claims.

These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts. As used herein, the singular forms "a", "an" and "the" are intended to comprise the plural forms as well, unless the context clearly indicates otherwise.

It is to be acknowledged that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" comprises any and all combinations of one or more of the associated listed items.

It will be acknowledged that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

Please refer to FIG. 1, which is a block diagram of a reference voltage circuit according to an embodiment of the present invention. As shown in FIG. 1, a reference voltage circuit comprises a bandgap reference circuit 10, a comparator 30, a storage circuit 20, and a controller 40. The storage circuit 20 comprises a capacitor C and a switch device SW. The enabling circuit 42 of the controller 40 transmits an enable signal EN1 and an enable signal EN2 to the bandgap reference circuit 10 and the comparator 30, respectively, so as to activate the bandgap reference circuit 10 and the comparator 30 to operate. The cycles of enable signal EN1 and the enable signal EN2 may be the same as or difference from that of the peak voltage, or the cycles of the enable signal EN1 and EN2 can partially overlap with that of the peak voltage; that is, the working period of the reference voltage circuit 10 can be different from, the same as, or partially overlapped with that of the comparator 30. Furthermore, the controller 40 is connected to the storage circuit 20 and configured to output a switching signal SS to the switch device SW, so that the switch device SW is turned on or off based on the switching frequency of the switching signal SS. The bandgap reference circuit 10 is connected to the storage circuit 20 and the comparator 30, the bandgap reference circuit 10 outputs a reference voltage Vref to the storage circuit 20 and the comparator 30, so as to charge the capacitor C. The comparator 30 compares the reference voltage Vref and the storage voltage Vc of the capacitor C. The storage voltage Vc of the capacitor C is used as the output voltage of the reference voltage circuit for operations of other circuits. The reference voltage circuit of the present invention can be operated in one of a first operating mode and a second operating mode, and the first operating mode is also called a normal functioning mode, and the second operating mode is also called a calibration mode. The circuit architecture and operations of the bandgap reference circuit 10, the comparator 30, the storage circuit 20 and the controller 40 in the first operating mode and the second operating mode will be illustrated in detail in following paragraphs.

In an embodiment, the frequencies of the enable signals EN1 and EN2 are different from each other, and the working time points of the bandgap reference circuit 10 and the comparator 30 are different from each other. In another embodiment, the time points of rising edges of the enable signals EN1 and EN2 are different from each other, and the frequencies of the enable signal EN1 and EN2 are equal to each other. Similarly, the working time points of the bandgap reference circuit 10 and the comparator 30 are different from each other.

Figure 2:
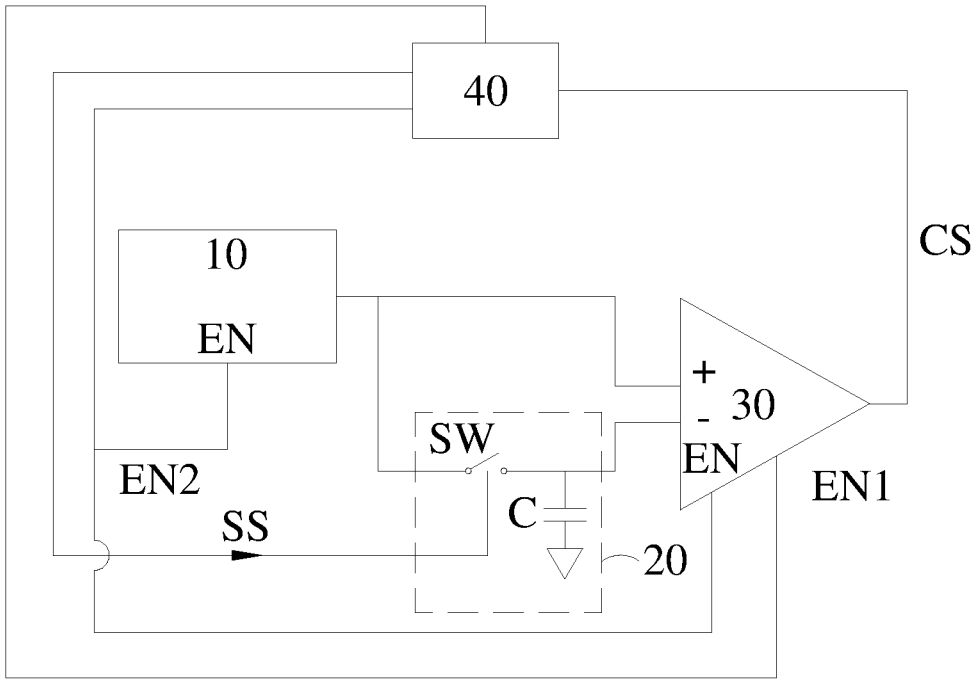
FIG. 2 is a circuit diagram of a reference voltage circuit, according to an embodiment of the present invention.

Please refer to FIG. 2, which is a circuit diagram of a reference voltage circuit, according to an embodiment of the present invention. As shown in FIG. 2, for example, the storage circuit 20 comprises a switch device SW and a capacitor C, the controller 40 is connected between the switch device SW and the comparator 30, the controller 40 is operated in one of the first operating mode or the second operating mode, and the configuration of other components is shown as FIG. 1. In the first operating mode, the controller 40 outputs the switching signal SS to the switch device SW, the switch device SW is continuously switched between turn-on and turn-off statues at the switching frequency of the switching signal SS. When the switch device SW is turned on, the capacitor C is charged until the storage voltage Vc is equal to the reference voltage Vref outputted from the reference voltage circuit 10; when the switch device SW is turned off, the capacitor C is stopped charging, and the storage voltage Vc of the capacitor C is reduced gradually because of the leakage current of the capacitor C, so the switch device SW is periodically turned on to charge the capacitor C to substantially maintain the storage voltage Vc at the reference voltage Vref, thereby preventing other circuits using the storage voltage Vc from being affected.

The leakage current of the capacitor C may vary in different operation environment, for example, in the operation environment with a higher temperature, the leakage current becomes larger and the reduction speed of the storage voltage Vc is quicker, so the switch device SW must be more frequently turned on to charge the capacitor C to substantially maintain the storage voltage Vc at the reference voltage Vref; in the other hand, in the operation environment with a lower temperature, the leakage current becomes smaller, and the reduction speed of the storage voltage Vc is slower, so the frequency of turning on the switch device SW to charge the capacitor C can be reduced, thereby reducing the power consumption of the reference voltage circuit. Therefore, a calibration scheme is required to adjust the switching frequency of the switching signal SS in response to different environmental temperature.

After the controller 40 enters the second operating mode, which is also called the calibration mode, the controller 40 controls the switch device SW to turn on to make the storage voltage Vc increase up to the reference voltage Vref. After the storage voltage Vc reaches the reference voltage Vref, the controller 40 controls the switch device SW to turn off to make the reference voltage Vref decrease, and the controller 40 can determine whether to adjust the switching frequency of the switching signal SS based on the reduction speed of the reference voltage Vref.

In an embodiment, the comparator 30 can be used to implement the aforementioned scheme. The positive terminal and the negative terminal of the comparator 30 are configured to receive the reference voltage Vref and the storage voltage Vc, respectively, and the comparator 30 outputs a comparison signal CS to the controller 40 based on the reference voltage Vref and the storage voltage Vc; for example, when the storage voltage Vc is continuously reduced to make the difference between the voltages on the positive terminal and the negative terminal of the comparator 30 greater than the offset voltage of the comparator 30, the comparator 30 outputs the comparison signal CS, and the controller 40 can determine the reduction speed of the storage voltage Vc of the capacitor C according to the time of receipt of the comparison signal CS, and then adjust the switching frequency of the switching signal SS based on the reduction speed.

In an embodiment, the controller 40 can use the counter 41 to estimate the reduction speed of the storage voltage Vc of the capacitor C. For example, in the second operating mode, when the controller 40 controls the switch device SW to turn off, the counter 41 starts to count until the comparison signal CS outputted from the comparator 30 is changed, and when the counter 41 stops counting, the counting value of the counter 41 can indicate that the time required to decrease the storage voltage Vc to below the offset voltage of the comparator 30, as a result, the higher counting value indicates a slower reduction speed of the storage voltage Vc, and smaller counting value indicates a faster reduction speed of the storage voltage Vc, so the controller 40 can adjust the switching frequency based on the counting value and a threshold CV. In an embodiment, the threshold CV can be a preset value, or a counting value measured in the previous calibration. It should be noted that the above-mentioned time point when the counter 41 starts counting is merely for exemplary illustration, the present invention is not limited thereto. In an embodiment, the counter 41 can perform counting based on the switching signal SS or another additional clock signal.

In an embodiment, the switch device SW can be a P-type transistor or a N-type transistor, and the transistor can be a thin-film transistor, a bottom-gate transistor, a top-gate transistor, a vertical TFT or the other appropriate transistor; however, the present invention is not limited to the above-mentioned exemplary list. In an embodiment, the controller 40 can be implemented by a microprocessor and related processing circuit, or by other appropriate processor, but the present invention is not limited to the above-mentioned exemplary list.

It should be noted that the first operating mode is the normal functioning mode of the reference voltage circuit of the present invention, and the second operating mode is the calibration mode of the reference voltage circuit of the present invention. The controller 40 compares the counting value and the threshold CV, and when the counting value is smaller than the threshold CV, it indicates that there is a larger leakage current, and the controller 40 can increase the switching frequency of the switching signal SS to speed up the switching operation of the switch device SW, so that the storage voltage Vc can be substantially maintained at the reference voltage Vref, and the effect of the leakage current can be reduced. When the counting value is higher than the threshold CV, it indicates that there is a smaller leakage current, and the controller 40 can decrease the switching frequency of the switching signal SS to slow down the switching operation of the switch device SW, so that the power consumption of the reference voltage circuit can be reduced.

Figure 3:
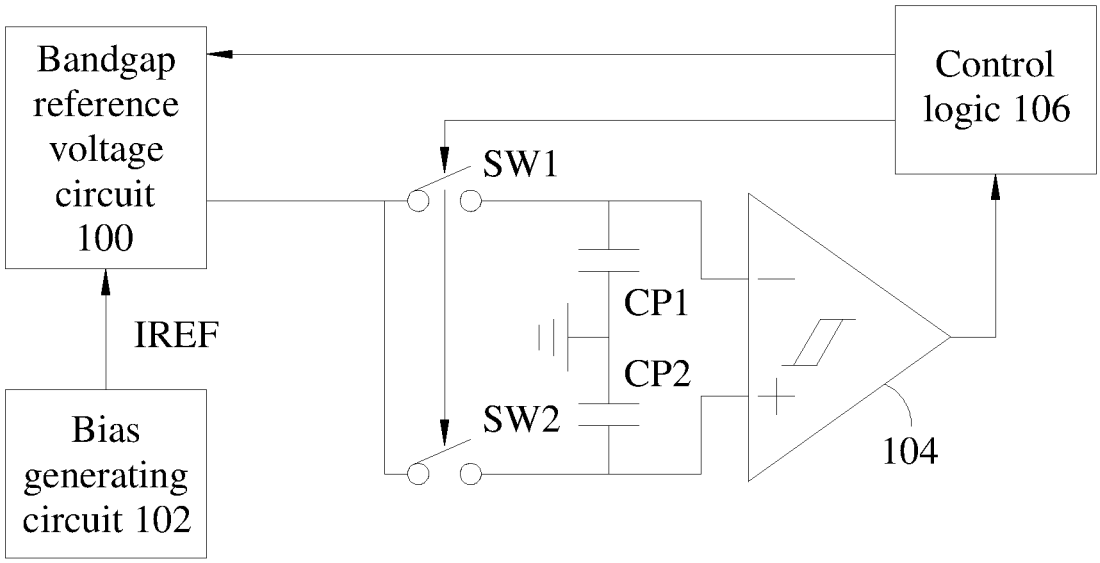
FIG. 3 (Prior art)
FIG. 3 is a circuit diagram of a conventional reference voltage circuit.

Please refer to FIG. 3, which is a circuit diagram of a conventional reference voltage circuit. As shown in FIG. 3, the conventional reference voltage circuit comprises a bandgap reference voltage circuit 100, a bias generating circuit 102, a first capacitor CP1, a second capacitor CP2, a first switch SW1, a second switch SW2, a comparator 104, and a control logic 106. The bandgap reference voltage circuit 100 is connected to the first switch SW1, the second switch SW2, the bias generating circuit 102 and the control logic 106. The first switch SW1 is connected to a negative terminal of the comparator 104, and the second switch SW2 is connected to a positive terminal of the comparator 104. The first terminal of the first capacitor CP1 is connected between the first switch SW1 and the negative terminal of the comparator 104, and the second terminal of the first capacitor CP1 is connected to the ground GND. The first terminal of the second capacitor CP2 is connected between the second switch SW2 and the positive terminal of the comparator 104, and the second terminal of the first capacitor CP1 is connected to ground GND. The capacitance of the second capacitor CP2 is greater than that of the first capacitor CP1. The control logic 106 is connected between the comparator 104 and the bandgap reference voltage circuit 100, and connected to the first switch SW1 and the second switch SW2. The control logic 106 controls the turn-on and turn-off operations of the first switch SW1 and the second switch SW2.

The bias generating circuit 102 provides a bias current IREF to the bandgap reference voltage circuit 100 for operation, the bandgap reference voltage circuit 100 outputs the bandgap reference voltage. When the control logic 106 controls the first switch SW1 and the second switch SW2 to turn on, the bandgap reference voltage can be provided to the first capacitor CP1 and the second capacitor CP2 to perform charging. When the first switch SW1 and the second switch SW2 are turned off, the bandgap reference voltage circuit 100 enters a sleep status for power saving.

In detail, when the first capacitor CP1 and the second capacitor CP2 are charged in the beginning, the voltages of the first capacitor CP1 and the second capacitor CP2 are increased slowly, the first capacitor CP1 and the second capacitor CP2 can be equivalent to open circuit, and at this time, the voltages on the positive terminal and the negative terminal of the comparator 104 are equal to each other. After the first capacitor CP1 and the second capacitor CP2 are charged completely, a voltage difference is formed between the voltages of the first capacitor CP1 and the second capacitor CP2, and the comparator 104 outputs the comparison signal according to the voltage difference and a preset voltage value.

The continuous turn-on and turn-off operations of the first switch SW1 and the second switch SW2 make the first capacitor CP1 and the second capacitor CP2 be charged completely, and the capacitances of the and the first capacitor CP1 and the second capacitor CP2 are different from each other, so the voltage reduction rates of the first capacitor CP1 and the second capacitor CP2 are different from each other. When the difference of the voltage on the first capacitor CP1 and the second capacitor CP2 is lower than the preset voltage value, the comparator 104 outputs the comparison signal to the control logic 106, so as to make the reference voltage circuit enter a power saving mode; when the difference between the voltages on the first capacitor CP1 and the second capacitor CP2 is higher than the preset value, the comparator 104 outputs the comparison signal to the control logic 106 so as to make the reference voltage circuit enter the active mode. The aforementioned scheme can achieve the power-saving effect.

However, the switching frequencies of the first switch SW1 and the second switch SW2 affect the voltages on the first capacitor CP1 and the second capacitor CP2, so the conventional reference voltage circuit using the first switch SW1 and the second switch SW2 with the switching frequencies of constant values is unable to adjust the switching frequency according to the actual condition of the circuit, and the power-saving effect is limited.

Compared with the conventional reference voltage circuit, the reference voltage circuit of the present invention is able to adjust the frequency of the switch device SW according to the actual condition of the circuit, to make the charging process of the capacitor C complete adaptively. The reference voltage circuit of the present invention has a simpler circuit configuration, so that the manufacturing cost can be reduced, and the power-saving effect can be improved.

Figure 4A:
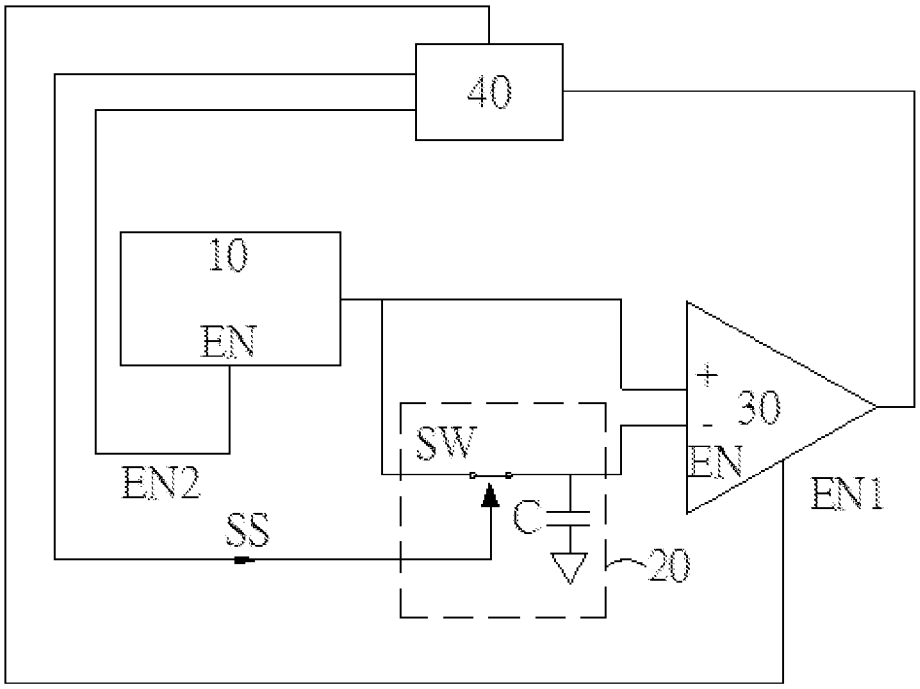
FIG. 4A is a schematic view showing an operation of a reference voltage circuit, in which a switch device is turned on in a first operating mode, according to an embodiment of the present invention.
Figure 4B:
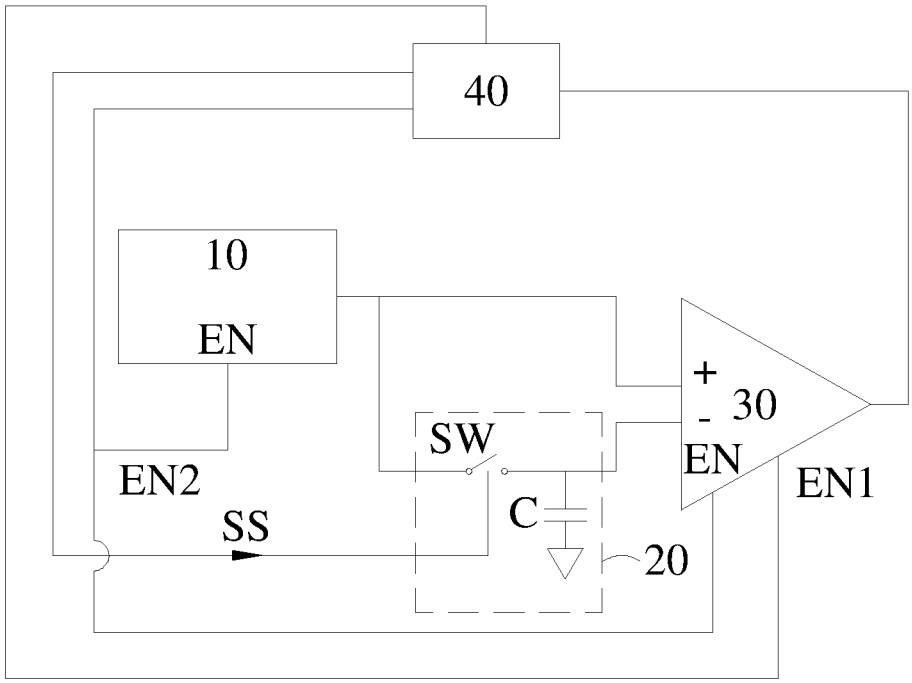
FIG. 4B is a schematic view showing an operation of the reference voltage circuit, in which the switch device is turned off in the first operating mode, according to an embodiment of the present invention.

Please refer to FIGS. 4A and 4B, which are schematic views showing operations of turning on and off a switch device of a reference voltage circuit in a first operating mode, respectively. As shown in FIG. 4A with reference to FIGS. 1 and 2, the controller 40 outputs the switching signal SS to turn on the switch device SW in the first operating mode, the capacitor C starts to charge. As shown in FIG. 4B with reference to FIGS. 1 and 2, the controller 40 outputs the switching signal SS to turn off the switch device SW in the first operating mode, so as to reduce the power consumption of the bandgap reference circuit 10. Based on the switching signal SS, the continuous turn-on and turn-off operations of the switch device SW can make the storage voltage Vc of the capacitor C substantively the same as the reference voltage Vref, so that the storage voltage Vc can be provided to other electronic components for normal operations.

In an embodiment, in the first operating mode, the comparator 30 is not activated, so that the power consumption of the reference voltage circuit can be reduced; however, the description merely for exemplary illustration, and the present invention is not limited thereto.

Figure 5:
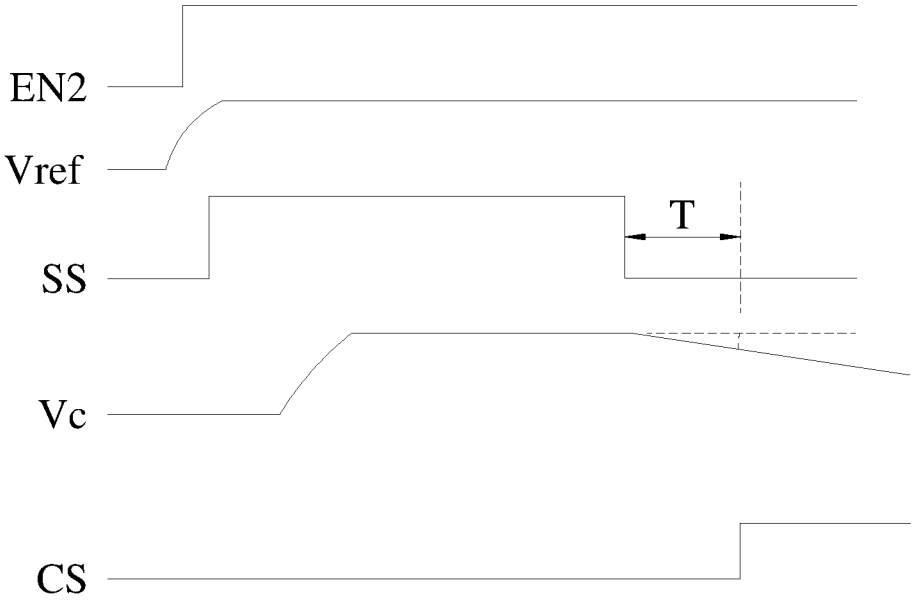
FIG. 5 is a signal waveform diagram of a reference voltage circuit, according to an embodiment of the present invention.

Please refer to FIG. 5, which is a signal waveform diagram of a reference voltage circuit of the present invention. As shown in FIG. 5 with reference to FIGS. 1 and 2, in the second operating mode, the controller 40 controls the switch device SW to turn on at the rising edge of the switching signal SS shown in FIG. 5, the capacitor C starts to charge until the storage voltage Vc of the capacitor C reaches the reference voltage Vref, and the controller 40 then controls the switch device SW to turn off at the falling edge of the switching signal SS shown in FIG. 5, and also activate the counter 41 to start counting. In the turn-off period of the switch device SW, the storage voltage Vc is gradually decreased because of leak current, as shown in FIG. 5, after the period T, the voltage difference between the positive terminal and the negative terminal of the comparator 30 is greater than an offset voltage of the comparator 30, the comparator 30 outputs the comparison signal CS, so as to trigger the counter 41 to stop counting. When the controller 40 determines that the counting value of the counter 41 is lower than the threshold CV, it indicates that the period T is shorter and the leakage current is larger, so the controller 40 can increase the switching frequency; as a result, in the first operating mode, the switch device SW can speed up the turn-on and turn-off operations according to the switching signal SS with the increased switching frequency. In the other hand, when the controller 40 determines that the counting value is higher than the threshold CV, it indicates that the period T is longer and the leakage current is smaller, so the controller 40 decreases the switching frequency; as a result, the turn-on and turn-off operations of the switch device SW is slowed down based on the switching signal SS with the decreased switching frequency.

In an embodiment, the controller 40 can periodically enter the second operating mode; for example, the controller 40 enters the second operating mode every calibration cycle such as one minute or five minutes, so as to determine whether to adjust the switching frequency of the switching signal SS. In an embodiment, the controller 40 can adjust the calibration cycle based on the reduction speed of the storage voltage Vc of the capacitor C; for example, when the controller 40 determines that the reduction speed of the storage voltage Vc of the capacitor C becomes faster, the controller 40 can decrease calibration cycle; when the controller 40 determines that the reduction speed of the storage voltage Vc of the capacitor C becomes slower, the controller 40 can increase calibration cycle.

In an embodiment, the controller 40 enters the second operating mode in response to the receipt of a trigger event, such as a trigger signal or the interrupt signal. For example, when a temperature measurement component of the system, where the reference voltage circuit of the present invention is disposed, measures a system temperature higher than a preset high temperature or lower than the preset low temperature, the temperature measurement component can output a trigger signal or an interrupt signal to the controller 40, so as to make the controller 40 enter the second operating mode to adjust the switching frequency of the switching signal SS and also selectively adjust the calibration cycle.

In an embodiment, in a condition that the comparator 30 is provided with an adjustable offset voltage, the controller 40 can adjust the offset voltage of the comparator 30 based on the reduction speed of the storage voltage Vc of the capacitor C; for example, when the controller 40 determines that the reduction speed of the storage voltage Vc of the capacitor C becomes faster, the offset voltage of the comparator 30 can be decreased; when the controller 40 determines that the reduction speed of the storage voltage Vc of the capacitor C becomes slower, the offset voltage of the comparator 30 can be increased.

For example, when the threshold CV is set as 10 and the counting value generated by the counter 41 is 8, the controller 40 determines that the counting value is lower than the threshold CV, so the controller 40 increases the switching frequency; when the counting value generated by the counter 41 is 20, the controller 40 determines that the counting value is higher than the threshold CV, so the controller 40 decreases the switching frequency.

Figure 6:
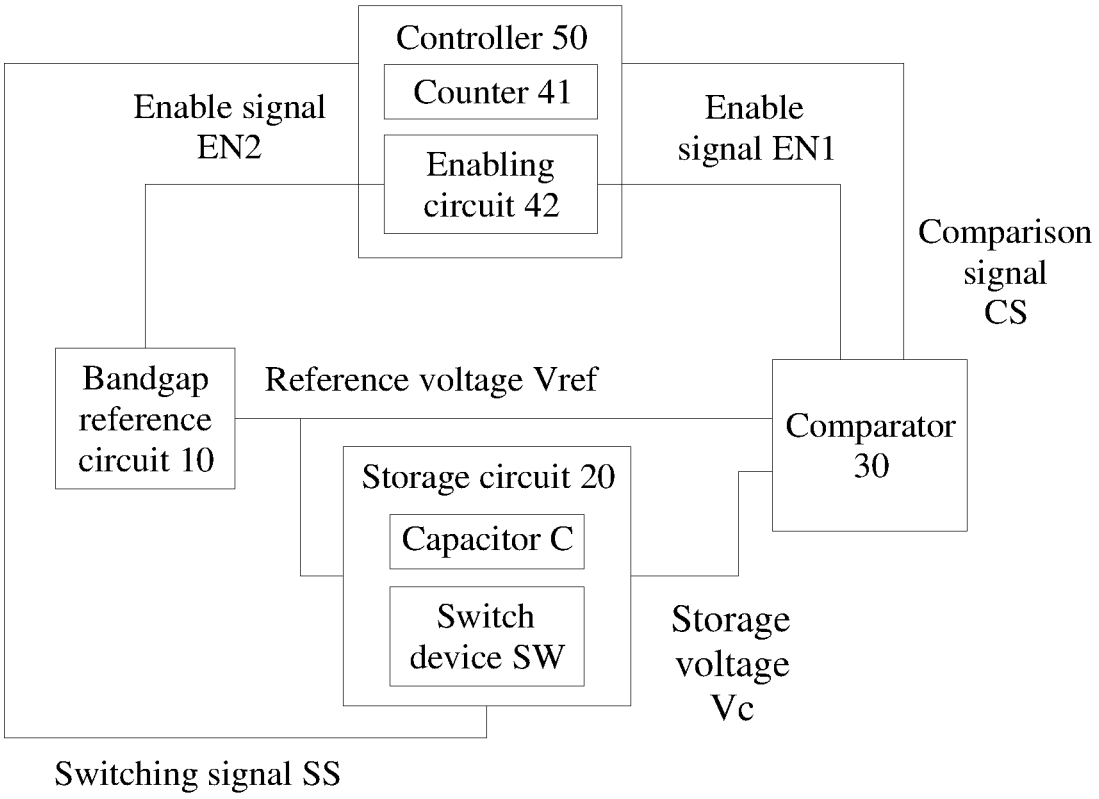
FIG. 6 is a circuit diagram of a reference voltage circuit, according to another embodiment of the present invention.

Please refer to FIG. 6, which is a block diagram of a reference voltage circuit according to another embodiment of the present invention. The difference between the embodiment of FIG. 6 and the embodiment of FIG. 1 is that the embodiment of FIG. 6 does not compare the counting value of the counter 41 with the threshold CV to determine whether to adjust the switching frequency, but directly convert the counting value of the counter 41 into the switching frequency, instead. For example, in a condition that the counting frequency of the counter 41 is 1 Hz, that is, the counting cycle is one second, and when the counting value of the counter 41 is 10 at the time point of change of the comparison signal CS outputted from the comparator 30, the controller 50 can determine to control the switch device SW at the switching frequency of the 0.1 Hz, that is, the controller 50 determines the switching cycle is 10 seconds. The controller 50 of this embodiment converts the counting value of the counter 41 into the switching cycle for controlling the switch device SW, for example, the controller 50 directly uses the counting time, which is required for the counter 41 to count to the counting value, as the switching cycle; in other embodiment, the controller 50 converts the counting time/value into the switching cycle/frequency based on a preset ratio or a lookup table.

The present invention disclosed herein has been described by means of specific embodiments. However, numerous modifications, variations and enhancements can be made thereto by those skilled in the art without departing from the spirit and scope of the disclosure set forth in the claims.

What is claimed is:

1. A reference voltage circuit, comprising:

a bandgap reference circuit;

a switch device;

a capacitor having a first terminal electrically connected to the bandgap reference circuit through the switch device; and a controller configured to output a switching signal to control the switch device, wherein the switching signal has a switching frequency;

wherein in a first operating mode, the controller controls the switch device to periodically turn on and off at the switching frequency, so as to control the bandgap reference circuit to charge the capacitor periodically at the switching frequency, and a voltage on the first terminal of the capacitor is used as an output voltage of the reference voltage circuit;

wherein in a second operating mode, the controller controls the switch device to control the switch device to turn off, so as to make the voltage on the first terminal of the capacitor reduce, and the controller determines the switching frequency based on a reduction speed of the voltage on the first terminal of the capacitor.

2. The reference voltage circuit according to claim 1, further comprising a comparator having a positive terminal and a negative terminal, wherein the positive terminal is coupled to the bandgap reference circuit, the negative terminal is coupled to the first terminal of the capacitor, and the comparator is activated in the second operating mode, and the comparator is triggered to output a comparison signal to the controller in response to a reduction amount of voltage on the first terminal of the capacitor, the controller determines the reduction speed of the voltage on the first terminal of the capacitor according to time of receiving the comparison signal.

3. The reference voltage circuit according to claim 2, wherein the controller comprises a counter configured to count to generate a counting value during a voltage reduction period of the negative terminal of the comparator, and the counter stops counting when receiving the comparison signal, and the controller determines the switching frequency based on the counting value.

4. The reference voltage circuit according to claim 3, wherein in the second operating mode, the controller increases the switching frequency when determining that the counting value is lower than a threshold.

5. The reference voltage circuit according to claim 3, wherein in the second operating mode, the controller decreases the switching frequency when determining that the counting value is higher than a threshold.

6. The reference voltage circuit according to claim 3, wherein the controller converts the counting value into the switching frequency based on a preset ratio or a lookup table.

7. The reference voltage circuit according to claim 2, wherein in the first operating mode the comparator is not activated.

8. The reference voltage circuit according to claim 2, wherein the controller periodically enters the second operating mode.

9. The reference voltage circuit according to claim 2, wherein the controller enters the second operating mode when receiving a trigger event.

10. The reference voltage circuit according to claim 1, wherein in the first operating mode, when the controller controls the switch device to turn on, the bandgap reference circuit charges the capacitor to make the voltage on the first terminal of the capacitor reach the voltage outputted by the bandgap reference circuit.

* * * * *